US006308682B1

(12) United States Patent
Ma

(10) Patent No.: US 6,308,682 B1
(45) Date of Patent: Oct. 30, 2001

(54) GASOLINE INTERNAL COMBUSTION ENGINE

(75) Inventor: Thomas Tsoi Hei Ma, Essex (GB)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/509,978

(22) PCT Filed: Sep. 11, 1998

(86) PCT No.: PCT/GB98/02754

§ 371 Date: Apr. 5, 2000

§ 102(e) Date: Apr. 5, 2000

(87) PCT Pub. No.: WO99/19612

PCT Pub. Date: Apr. 22, 1999

(30) Foreign Application Priority Data

Oct. 9, 1997 (GB) ..... 9721313

(51) Int. Cl.[7] ..... F02B 17/00

(52) U.S. Cl. ..... 123/295; 123/299; 123/305; 123/430

(58) Field of Search ..... 123/295, 299, 123/300, 305, 430

(56) References Cited

U.S. PATENT DOCUMENTS

| | | | | |
|---|---|---|---|---|
| 4,117,813 | * | 10/1978 | Yamashita et al. | 123/334 |
| 4,147,136 | * | 4/1979 | Noguchi et al. | 123/557 |
| 4,492,194 | * | 1/1985 | Chmela et al. | 123/276 |
| 4,771,748 | * | 9/1988 | Chmela et al. | 123/276 |
| 5,052,360 | * | 10/1991 | Ingle, III et al. | 123/430 |
| 5,373,820 | | 12/1994 | Sakamoto . | |
| 5,579,740 | | 12/1996 | Cotton . | |
| 5,617,823 | * | 4/1997 | Gray, Jr. et al. | 123/254 |
| 6,167,865 | * | 1/2001 | Ma | 123/308 |

FOREIGN PATENT DOCUMENTS

| | | |
|---|---|---|
| 60 113019 A | 6/1985 | (JP) . |
| 60 113020 | 6/1985 | (JP) . |

* cited by examiner

*Primary Examiner*—Henry C. Yuen
*Assistant Examiner*—Hieu T. Vo
(74) *Attorney, Agent, or Firm*—Carlos L. Hanze

(57) ABSTRACT

A spark ignition gasoline internal combustion engine separates a gasoline fuel supply into a higher boiling point fraction and a lower boiling point fraction, supplies the boiling point fractions to combustion chambers of the engine, and introduces the separate boiling point fractions into the combustion chambers to produce a stratified charge with the different fractions residing in different parts of the combustion chamber. In accordance with a preferred embodiment, charge stratification under "full load" operating conditions is such that in each combustion chamber the lower boiling point fraction is ignited by a spark plug, which in turn produces a propagating flame that ignites the higher boiling point fraction concentrated in the end gas regions of the combustion chamber.

7 Claims, 2 Drawing Sheets

GASOLINE INTERNAL COMBUSTION ENGINE

FIELD OF THE INVENTION

The present invention relates to a spark ignition gasoline internal combustion engine having means for separating the gasoline fuel into a higher boiling point fraction and a lower boiling point fraction, means for separately supplying the fractions to the combustion chambers of the engine, and means for introducing the separate fractions into the combustion chambers in such as a manner as to produce a stratified charge with the different fractions residing in different parts of the combustion chamber.

BACKGROUND OF THE INVENTION

Various proposals can be found in the prior art for stratifying the intake charge in an engine having one or more intake valves per cylinder by regulating the speed of the air flow along different regions of the skirts of the open valves during the induction stroke. The intake ports leading to the intake valves can be partitioned into separate passages and a flow control valve may regulate the relative air flows along the different passages by throttling one of the passages in order to direct the air flows from the other passages to different regions of the combustion chamber so as to promote charge stratification. Depending on the geometry of the intake system and the positioning of the flow control valve, the intake charge can be made to swirl (i.e. vortex about the cylinder axis) or tumble (i.e. vortex about an axis transverse to the cylinder axis). In the case of swirl, the intake charge is radially stratified with the flow from the throttled passage remaining at the centre of the vortex near the axis of the combustion chamber. In the case of tumble, the intake charge is stratified in layers lying in planes parallel to the cylinder axis.

It has also recently been proposed by the present Applicant in GB Patent Application No. 9716156.6 to provide a fuel vapour extraction system for a gasoline engine capable of continuously separating the fuel into a lighter vapour fraction and a heavier liquid fraction, the ratio of the two fractions being adjustable and the sum of the two fractions always matching the fuel demand from the engine. Such a vapour extraction system can continuously supply to the engine separately a vapour fraction that is easily ignitable and a liquid fraction that is more resistant to knock.

The Applicant's copending British Patent Appln. No. 9716829.8 relates to a gasoline spark ignition internal combustion engine having two or more intake passages supplying combustion air to each engine cylinder and a flow control valve regulating the air flow along one of the passages to each engine cylinder. The engine includes a vapour extraction system for separating the gasoline fuel into a lighter vapour fraction and a heavier liquid fraction. During part load operation of the engine, the air flow along the passage is throttled by the flow control valve, resulting in stratification of the intake charge in the combustion chamber of the cylinder with the gases flowing along the throttled passage remaining in the vicinity of a spark plug near the centre of the combustion chamber at the instant of spark ignition. At the same time, fuel from the vapour fraction is introduced into the intake passage throttled by the flow control valve to increase the concentration of the lighter fraction of the gasoline fuel in the vicinity of the spark plug at the instant of spark ignition.

The above copending patent application is only concerned with part load operation and is concerned with improving lean burn capability of the engine by improving the robustness of the lean combustion during part load operation. The proposal in this earlier patent is to revert to homogeneous charge preparation under full load operating conditions, because at that time the mixture is stoichiometric or rich and there is nothing to be gained in stratifying the charge distribution.

The Applicant's copending British Patent Appln. No. 9716157.4 also described an engine that uses charge stratification under part load and separates the gasoline fuel into a lighter and a heavier fraction. In this case, the lighter fraction is positioned away from the spark plug in order that it may spontaneously ignite but only after it has been compressed and heated by the advancing flame front from the part of the charge ignited by the spark. Here the objective is to produce controlled auto-ignition in order to reduce NOx emission and achieve very lean combustion. Once again, under full load operating conditions, the engine would be operated with a homogeneous charge as engine knock occurring under such conditions would damage the engine.

SUMMARY OF THE INVENTION

According to the present invention, there is provided a spark ignition gasoline internal combustion engine having means for separating the gasoline fuel into a higher boiling point fraction and a lower boiling point fraction, means for separately supplying the fractions to the combustion chambers of the engine, and means for introducing the separate fractions into the combustion chambers in such as a manner as to produce a stratified charge with the different fractions residing in different parts of the combustion chamber, wherein the charge stratification under full load operating conditions of the engine is such that the lower boiling point fraction is ignited by the spark plug to burn first and initiate a flame that propagates through the combustible charge, and the higher boiling point fraction is concentrated in the end gas regions that are the last to be ignited by the advancing flame front and are most prone to knock.

Unlike the present invention, none of the earlier proposals above is concerned with the full load operating conditions. The present invention proposes running the engine with a stratified charge under full load conditions and at the same time ensuring that the higher boiling point fraction, which contains mostly aromatic components of the fuel that are highly resistant to knock, are concentrated in the end gas regions that are the most prone to knock. Furthermore, the lower boiling point fraction, which contains the lower octane rating paraffins and olefins, is burnt first and does not have the time and the temperature to achieve autoignition. As a result, the overall resistance to knock by the engine is increased. As it is the risk of knocking and engine damage under high load that places a limit on the engine compression ratio, the invention allows a higher compression ratio to be used safely with any given gasoline fuel, giving rise to improved efficiency and performance.

Unlike the earlier proposals, it is not essential to concentrate the lower boiling point fraction of the fuel in any one region of the combustion chamber and it is possible to distribute this lower boiling point fraction evenly throughout the combustion chamber provided only that under high load operating conditions, the higher boiling point fraction is concentrated in the end gas region.

Also unlike the earlier proposals, it is not sufficient that the higher boiling point fraction should reside away from the spark plug in the remoter region of the combustion chamber. In the present invention, it is essential to specifically locate the end gas regions which are most prone to knock and to concentrate the higher boiling point fraction at least in those regions. Typically the end gas region would reside in the part of the combustion chamber furthest away from the spark plug, but its exact position would depend on factors such as bulk charge motion displacing the ignition kernel away from the actual position of the spark gap, and local heating of the combustible charge by hot wall surfaces such as the exhaust valves. Because of these effects, even though the spark plug may be centrally located in a axially symmetrical combustion chamber, the end gas region most prone to knock may not be uniformly distributed around the entire circumference, but may reside in localised parts of the circumference. The exact position of such end gas regions will be best determined experimentally.

Because the higher boiling point fraction of the fuel is in liquid form and evaporates slowly, it is in practice relatively easy to achieve charge stratification in the end gas regions by directing a spray of the fuel into selected parts of the engine intake port, injecting when the intake valve is open and relying on the bulk motion of the intake charge to carry the fuel to the desired regions in the combustion chamber.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 2:
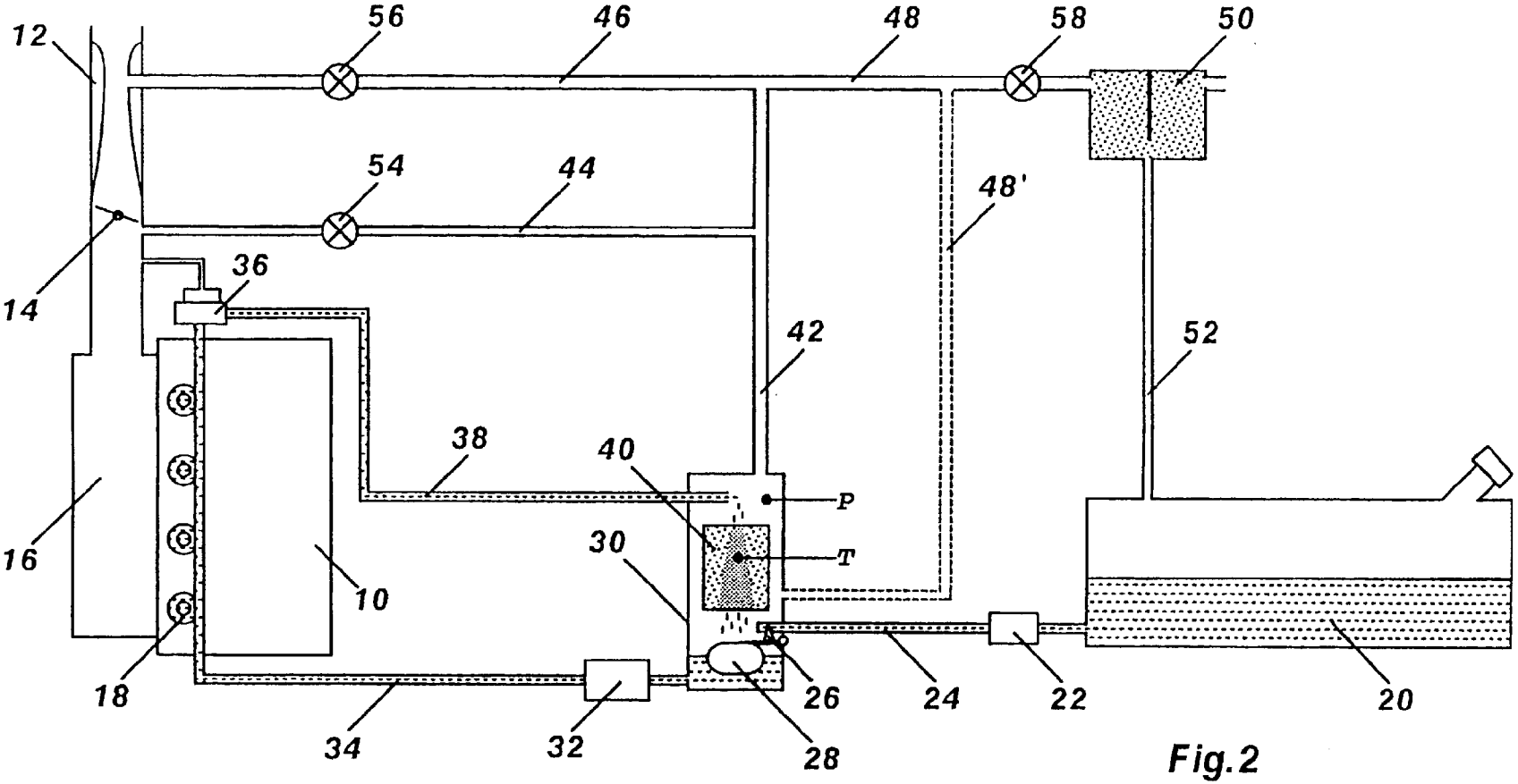
FIG. 2 is a block diagram similar to the single drawing of copending patent application No. 9716156.6 that shows a continuous fuel vapour extraction system.

The present invention relies on the availability of separate continuous supplies of vapour fuel and liquid fuel. These can be derived from separation of gasoline into a lighter and a heavier fraction in the manner that will now be described with reference to FIG. 2, this being the subject of the above mentioned copending patent application No. 9716156.6.

An engine 10 has an intake manifold 16, a main throttle 14 and an intake passage containing a venturi 12. A fuel injection system for the engine comprises a fuel circulation pump 32 that supplies fuel under pressure into a fuel rail 34 from which fuel is dispensed to the individual cylinders of the engine by fuel injectors 18. The pressure in the fuel rail 34 is regulated by a relief valve 36 that derives a reference pressure from the intake manifold 16. Surplus fuel is spilled by the relief valve 36 into a fuel return pipe 38.

While it is conventional for the pump 32 and the return pipe 38 to be directly connected to the main fuel storage tank, designated 20 in the drawing, they are connected instead to a volatising chamber 30 that contains a much smaller quantity of fuel. The volatising chamber 30 is connected to the main fuel tank 20 by a supply pipe 24 containing a fuel lifter pump 22 and the level of fuel within the chamber 30 is maintained constant by means of a float 28 and a valve 26.

An evaporator 40 is disposed in the vapour filled space of the chamber 30 above the liquid level and in the path of the fuel returned by way of the fuel return pipe 38. The return fuel is sprayed over the evaporator and the latter is designed to have a large surface area that is coated with a film of fuel. The large surface area may be achieved by using a matrix of capillaries or a porous or sintered block for the evaporator 40. Neither the evaporator 40 nor the fuel in the chamber 30 is heated and evaporation relies on the reduced pressure in the vapour space, the dispersion of the spray droplets, the large surface area of the evaporator 40 and such heat as the return fuel picks up during its circulation flow. The matrix of the evaporator 40 may be formed of a hydrocarbon storage material such as activated carbon to increase the quantity of vapour that can readily be extracted under dynamic conditions.

To maintain the vapour space in the volatising chamber 30 below atmospheric pressure, a pipe 42 leading from it is connected by way of a first pipe 46 and a regulating valve 56 to the venturi 12 and by way of a second pipe 44 and a regulating valve 54 to the intake manifold 16. The pipe 46 is also connected by way of a pipe 48 and a regulating valve 58 to a vapour canister 50 that is itself connected to the ullage space of the main fuel tank 20 by a pipe 52. Instead of the pipe 48 being connected to the pipe 46 to allow fuel vapour stored in the vapour canister 50 to be purged directly into the venturi 12, it is alternatively possible as represented by the pipe 48' shown in dotted lines to route the purge flow to the venturi 12 through the volatising chamber 30.

Under idling and low load conditions, a high vacuum will be present in the intake manifold 16 which will result in a high rate of evaporation of the fuel in the volatising chamber 30 and the bulk of the fuel requirement will be delivered to the engine in vapour form. A small quantity of liquid fuel corresponding to the unvaporised fraction of the fuel will be supplied by the fuel injection system so as to maintain the composition of the fuel consumed overall the same as that present in the fuel storage tank 20.

As the engine load is increased progressively, the pressure in the intake manifold 16 will rise towards atmospheric pressure while the venturi pressure will drop with increasing air flow. By suitable selection of the position of the regulating valves 54 and 56 the vacuum pressure in the volatising chamber 30 can be set to supply vapour at any desired rate while the balance of the fuel to make up the original composition of the fuel is injected by the fuel injectors. During this mode of operation the vacuum alone would not be sufficient to maintain the rate of vapour supply continuously but as a large proportion of the fuel is recirculated in the loop 32, 34, 36, 38 the cooling of the evaporator 40 will be compensated by heat picked up by the recirculating fuel and the evaporation rate will stabilise.

Under high load conditions, there will be hardly any vacuum in the intake manifold 14 but a high vacuum at the venturi 12.

The rate of supply of fuel in vapour form to the engine depends upon the pressure and temperature prevailing in the volatising chamber 30 and the position of the regulating valves 54 and 56. The engine control system will first decide the total quantity of fuel to be burnt and the fractions to be supplied in vapour and liquid forms. Based upon these variables, as can be prior determined by conventional engine fuel calibration maps, the engine management system can set the positions of the regulating valves 54 and 56 to achieve the desired vapour flow rate and the pulse width of the fuel injectors 18 to achieve the desired liquid flow rate.

The earlier mentioned copending patent applications make use of the availability of two fractions of the fuel with different boiling points to improve combustion and reduce exhaust emissions during low and medium load operating conditions of the engine. By contrast, the present invention is concerned primarily with the stratification of the charge in the combustion chambers under high load and full load operating conditions and proposes directing the fuel fractions of different boiling point to different part of the combustion chambers in such a manner as to reduce the tendency of the engine to knock. The manner in which charge stratification can be achieved by the design of the intake port and the positioning and timing of the fuel injection are all known per se and the invention will be described only by reference to the location of the high boiling point fraction of the fuel in the combustion chambers during the combustion process.

Usually, engines are operated under high load conditions with a homogeneous charge and the mixture strength is stoichiometric or richer to make sure that all the available air is utilised. A flame ignited by a spark spreads through the charge at the same time raising the temperature and pressure of the fuel forward of the flame front. By the time the flame reaches the so-called end gas regions, which are usually but not essentially near the periphery of the combustion chamber, the temperature and pressure in these regions is so high that the mixture is prone to spontaneous ignition and it is this spontaneous combustion that is the cause of knock. At high load, this knock releases enough energy not only to create the noise associated with autoignition (hence the term "knock" that is used to describe it) but can also cause serious damage to the engine.

The temperature and pressure in the end gas regions is dependent upon the compression ratio of the engine. Higher compression ratios are desirable from the points of view of efficiency and maximum power but for any given fuel a limit is placed on the maximum compression ratio because it is essential to avoid autoignition under full load operation.

Figure 1:
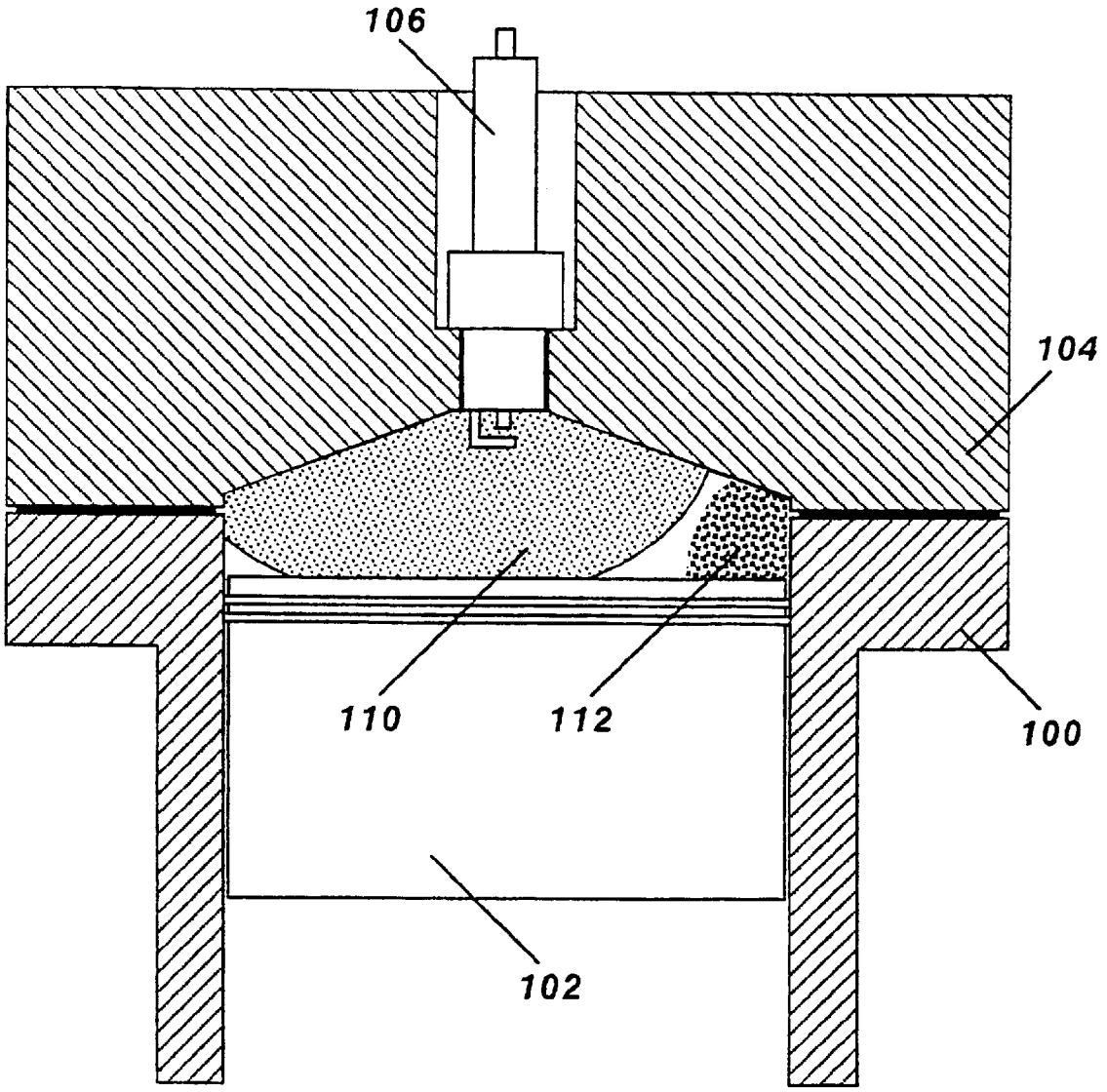
FIG. 1 is a section through a combustion chamber showing an example of charge stratification that is suitable in implementing the present invention.

The present invention relies on the fact that for any given fuel one can reduce the tendency for the mixture in the end gas regions to autoignite by concentrating in these regions the fraction of the fuel with the higher boiling point and octane rating. In FIG. 1, the spark plug 106 is arranged at the centre of an axially symmetrical combustion chamber defined by a cylinder block 100, a cylinder head 104 and a piston 102. The part of the charge containing the lower boiling point fraction of the fuel is designated 110 and it is through this fraction that the flame ignited by the spark plug 106 spreads. The part of the charge containing the higher boiling point fraction is designated 112 and is positioned to coincide with the end gas region that is the last to be ignited by the advancing flame front. The flame is skewed on account of the charge motion and despite the symmetry of the combustion chamber one cannot assume that the entire periphery of the combustion chamber will constitute the end gas region. As illustrated, the end gases can be concentrated in an isolated pocket and this is best located empirically by experiment, i.e. by trial and error.

Because the higher boiling point fraction of the fuel is in liquid form and evaporates slowly, it is in practice relatively easy to achieve charge stratification in the end gas regions by directing a spray of the fuel into selected parts of the engine intake port, injecting when the intake valve is open and relying on the bulk motion of the intake charge to carry the fuel to the desired regions in the combustion chamber.

What is claimed is:

1. A gasoline internal combustion engine having at least one spark plug in cooperation with a corresponding combustion chamber, the engine comprising:

fuel separating means for separating gasoline fuel into a higher boiling point fraction and a lower boiling point fraction;

supply means for separately supplying the boiling point fractions to the combustion chamber; and means for introducing the separate boiling point fractions into the combustion chamber so as to produce a stratified charge with the higher and lower boiling point fractions residing in different parts of the combustion chamber, wherein the charge under full load operating conditions of the engine is such that the lower boiling point fraction is ignited by the spark plug to burn first and initiate a flame that propagates through the charge, and the higher boiling point fraction is the last to be ignited by the propagating flame.

2. The engine according to claim 1, wherein the lower boiling point fraction is not concentrated in any one region of the combustion chamber.

3. The engine according to claim 1, wherein the higher boiling point fraction of the fuel is concentrated in end gas regions within the combustion chamber.

4. The engine according to claim 1, further comprising:

an intake port;

an intake valve in cooperation with said intake port through which an intake charge passes into the combustion chamber when said intake valve is open; and means in cooperation with said intake port and intake valve for directing a spray of the higher boiling point fraction into selected parts of the intake port, the higher boiling point fraction being injected when the intake valve is open and carried to the desired regions within the combustion chamber by bulk motion of the intake charge.

5. A method for operating a spark ignition internal combustion engine having at least one spark plug in cooperation with a corresponding combustion chamber, comprising:

providing a gasoline fuel supply to the combustion chamber;

separating the gasoline fuel supply for the engine into a higher boiling point fraction and a lower boiling point fraction;

directing each of the boiling point fractions into different parts of the combustion chamber to form a stratified charge; and igniting the lower boiling point fraction to form a propagating flame through the charge and a subsequent ignition of the higher boiling point fraction so as to minimize engine knock under full load operating conditions of the engine.

6. The method according to claim 5, wherein said directing step comprises directing the lower boiling point fraction away from an end gas region within the combustion chamber.

7. The method according to claim 5, wherein said directing step comprises directing the higher boiling point fraction to end gas regions within the combustion chamber.

* * * * *